United States Patent [19]

DeGrazia, Jr.

[11] Patent Number: 4,676,206

[45] Date of Patent: Jun. 30, 1987

[54] INTERLOCKED REMOTE OIL FILTER AND DRAIN

[76] Inventor: Torey W. DeGrazia, Jr., 1014 S. Greenwood, Park Ridge, Ill. 60068

[21] Appl. No.: 896,083

[22] Filed: Aug. 13, 1986

[51] Int. Cl.[4] ..... F01M 1/00

[52] U.S. Cl. ..... 123/196 S; 123/196 A; 184/1.5; 210/168

[58] Field of Search ..... 123/196 R, 196 S, 196 A; 184/1.5; 210/168

[56] References Cited

U.S. PATENT DOCUMENTS

| | | | |
|---|---|---|---|
| 1,992,371 | 2/1935 | Hammond et al. | 184/1.5 |
| 1,995,174 | 3/1935 | Gerrard et al. | 137/34 |
| 2,187,247 | 1/1940 | Nichols | 137/139 |
| 2,657,705 | 11/1953 | Gerhard et al. | 137/351 |
| 2,691,429 | 10/1954 | Kovacs | 184/6 |
| 3,087,582 | 4/1963 | Potter | 184/6 |
| 3,112,012 | 11/1963 | Hoch | 184/1.5 |
| 3,310,133 | 3/1967 | Eaker | 184/1.5 |
| 3,422,807 | 1/1969 | Waldecker | 123/196 |
| 3,477,459 | 11/1969 | Schossow | 137/351 |
| 3,540,594 | 11/1970 | Sanderson | 210/232 |
| 3,557,767 | 1/1971 | Green | 123/196 |
| 3,650,352 | 3/1972 | Schwary | 184/1.5 |
| 3,727,638 | 4/1973 | Zaremba, Jr. et al. | 137/572 |
| 3,743,096 | 7/1973 | Harvey, Jr. et al. | 210/232 |
| 3,871,483 | 3/1975 | Espinosa et al. | 184/1.5 |
| 3,929,643 | 12/1975 | Donaldson et al. | 210/117 |
| 3,954,250 | 5/1976 | Grace | 251/144 |
| 3,982,520 | 9/1976 | Wheeler | 123/196 |
| 4,032,447 | 6/1977 | Douglass | 210/168 |
| 4,051,036 | 9/1977 | Conrad et al. | 210/232 |
| 4,086,981 | 5/1978 | Mitsui | 184/1.5 |
| 4,151,823 | 5/1979 | Grosse et al. | 123/196 A |
| 4,174,699 | 11/1979 | Gill | 123/196 S |
| 4,193,442 | 3/1980 | Vian | 165/35 |
| 4,242,201 | 12/1980 | Stephens et al. | 210/240 |
| 4,298,469 | 11/1981 | LeBlanc et al. | 210/168 |
| 4,319,664 | 3/1982 | Price et al. | 184/1.5 |
| 4,335,688 | 6/1982 | Diederich, Jr. | 123/196 A |
| 4,371,439 | 2/1983 | Thornton | 210/232 |
| 4,402,287 | 9/1983 | Cochran | 123/196 A |
| 4,406,784 | 9/1983 | Cochran | 210/168 |
| 4,433,656 | 2/1984 | Norwood, Sr. | 123/196 A |
| 4,449,613 | 5/1984 | Price | 184/1.5 |
| 4,452,695 | 6/1984 | Schmidt | 210/168 |
| 4,479,468 | 10/1984 | Norwood, Sr. | 123/196 S |
| 4,492,632 | 1/1985 | Mattson | 210/168 |
| 4,495,963 | 1/1985 | Hensley | 137/351 |

*Primary Examiner*—E. Rollins Cross

*Attorney, Agent, or Firm*—Gerald M. Newman

[57] ABSTRACT

A remotely located oil filter and a remotely operated sump drain valve are interlocked such that the drain valve can only be operated when the oil filter is removed. A cable is connected to a lever which is pivotally mounted to open the drain valve in response to movement of a bracket that is affixed to an oil filter plate. Movement of the bracket is impeded by the installed oil filter so that the drain valve cannot be opened unless the oil filter is removed.

7 Claims, 10 Drawing Figures

FIG. 4
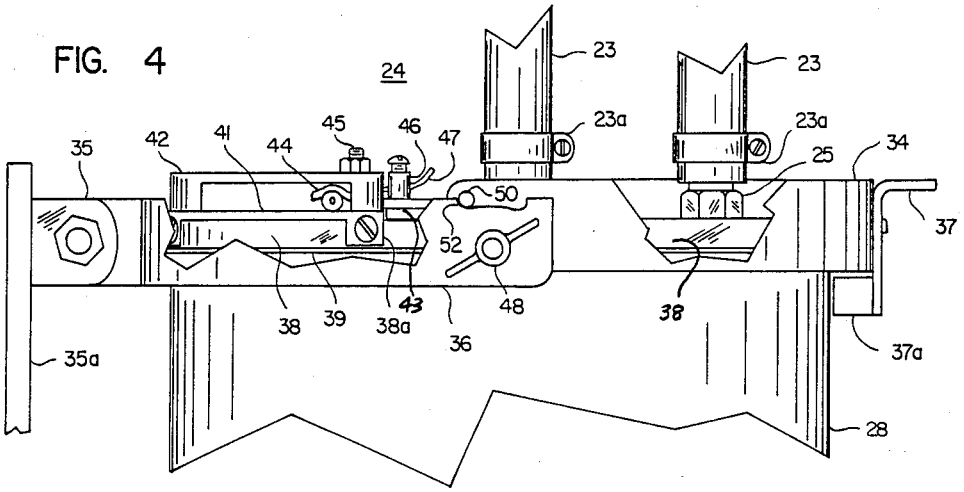
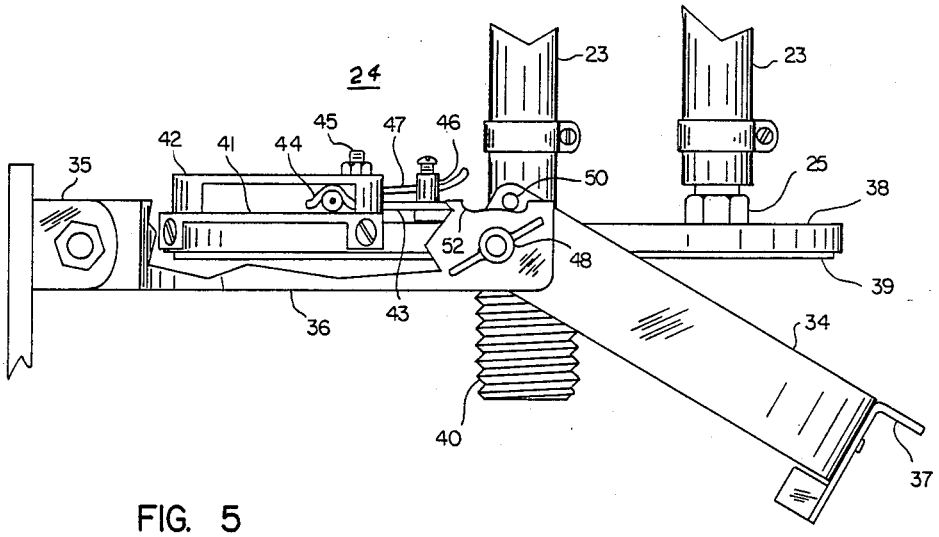
FIG. 5

INTERLOCKED REMOTE OIL FILTER AND DRAIN

BACKGROUND OF THE INVENTION AND PRIOR ART

This invention relates to servicing of automobile engines and, in particular, to routine maintenance involving changing of the engine oil and oil filter.

As is well known, a modern automobile engine is designed for longevity and relatively low maintenance. Key factor in obtaining optimum service from an engine are periodic replacement of the engine lubricating oil and oil filter. The modern automobile also embodies a host of optional features, such as air conditioning, power steering, cruise control, and power windows and locks. Additionally, styling is tending toward smaller vehicles, with the result that the engine compartment that houses the power equipment has become very cluttered. It is often very difficult to reach, much less to replace, the factoryinstalled oil filter which generally comprises a canister that is held in place against a suitable engine oil filter mount by means of a centrally threaded aperture. While such filters are installed by hand, they require the use of a special tool for removal which is not easily manipulated in a crowded engine compartment. The prior art includes a number of patents that teach relocation of the engine oil filter to a more easily accessible position in the engine compartment.

The engine includes a sump or oil pan for retaining the engine oil. Certain engine components may be "splash-lubricated" from the sump, but most are supplied with oil under pressure from an engine oil pump that is supplied with oil from the sump. The sump is fitted with a drain fitting consisting of a removable plug for draining the engine oil. Oil removal generally involves elevating the automobile on a suitable hoist to permit access to the underside thereof or crawling under the automobile to remove the drain fitting. An average automobile owner who changes the oil and oil filter doesn't have an automobile hoist at his disposal and is forced to take the latter approach. The oil change procedure is not only very messy, it is often quite dangerous. Here again, there are many prior art references that teach systems for remotely draining the engine oil by replacing the sump drain plug with a special drain fitting. There are also systems for preventing accidental draining of the oil. Any remote oil changing device must be cautiously used to guard against inadvertent operation with the undesirable result of, at best, spilling oil on the ground and, at worst, destroying the engine. With the present invention, that possibility is substantially precluded by a very simple, low cost interlock arrangement between the remote drain valve operating cable and the engine oil filter itself. Unless the oil filter has been removed, the sump drain valve cannot be operated.

OBJECTS OF THE INVENTION

A principal object of the invention is to provide a novel, remote oil and oil filter changing arrangement for an automobile.

Another object of the invention is to provide a remote oil filter and interlocked drain arrangement for an automobile engine.

A further object of the invention is to provide a simple, easy to use, oil and filter changing system for an automobile engine.

BRIEF DESCRIPTION OF THE DRAWINGS

These and other objects of the invention will be apparent upon reading the following description in conjunction with the drawings in which:

FIGS. 4 and 5 are enlarged, partial side views of the drain cable operating apparatus of the invention:

DESCRIPTION OF THE PREFERRED EMBODIMENT

Figure 1:
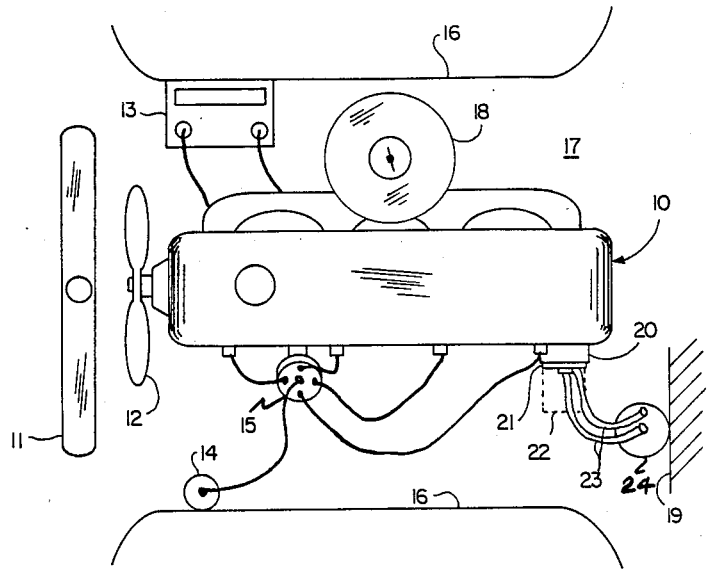
FIG. 1 is a simplified plan view of an engine compartment and engine.

Referring to FIG. 1, an engine 10 is situated in an engine compartment 17 which may include a radiator 11, a fan 12 affixed to the engine, a battery 13, an ignition coil 14, a distributor 15, body fender walls 16 and an air cleaner 18. The diagram is representative only and illustrates one of the many possible arrangements of components within an engine compartment. Generally, the engine compartment of a modern automobile is much more crowded than that shown.

Figure 2:
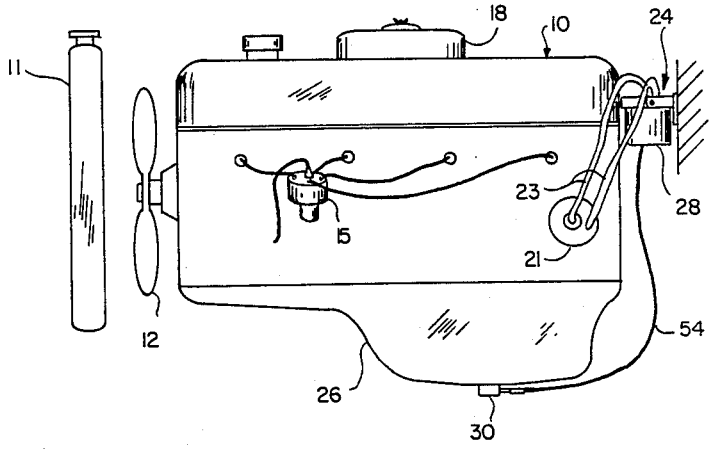
FIG. 2 is a simplified side view of the engine of FIG. 1.

An engine oil filtering system includes an engine mount 20 and a canister-type oil filter 22 illustrated in dashed lines. In accordance with a first aspect of the invention, an engine adapter plate 21 is affixed to engine mount 20 and, by means of a pair of high pressure hoses 23 and an oil filter mounting means 24, the oil filter is relocated to a firewall 19, or to any other convenient location within the engine compartment. As best shown in FIG. 2, an oil filter 28, which may be a readily available standard type, an improved type or simply the factoryinstalled unit, is positioned in a more accessible location to permit ready removal thereof. A sump or oil pan 26 is fitted to the bottom of engine 10 and includes a drain means 30 that is remotely operated by means of a cable 54 interconnected with oil filter mounting means 24. It will be appreciated by those skilled in the art that the conventional drain plug for sump 26 has been removed, and the remote drain means of the invention installed in place thereof.

Figure 3:
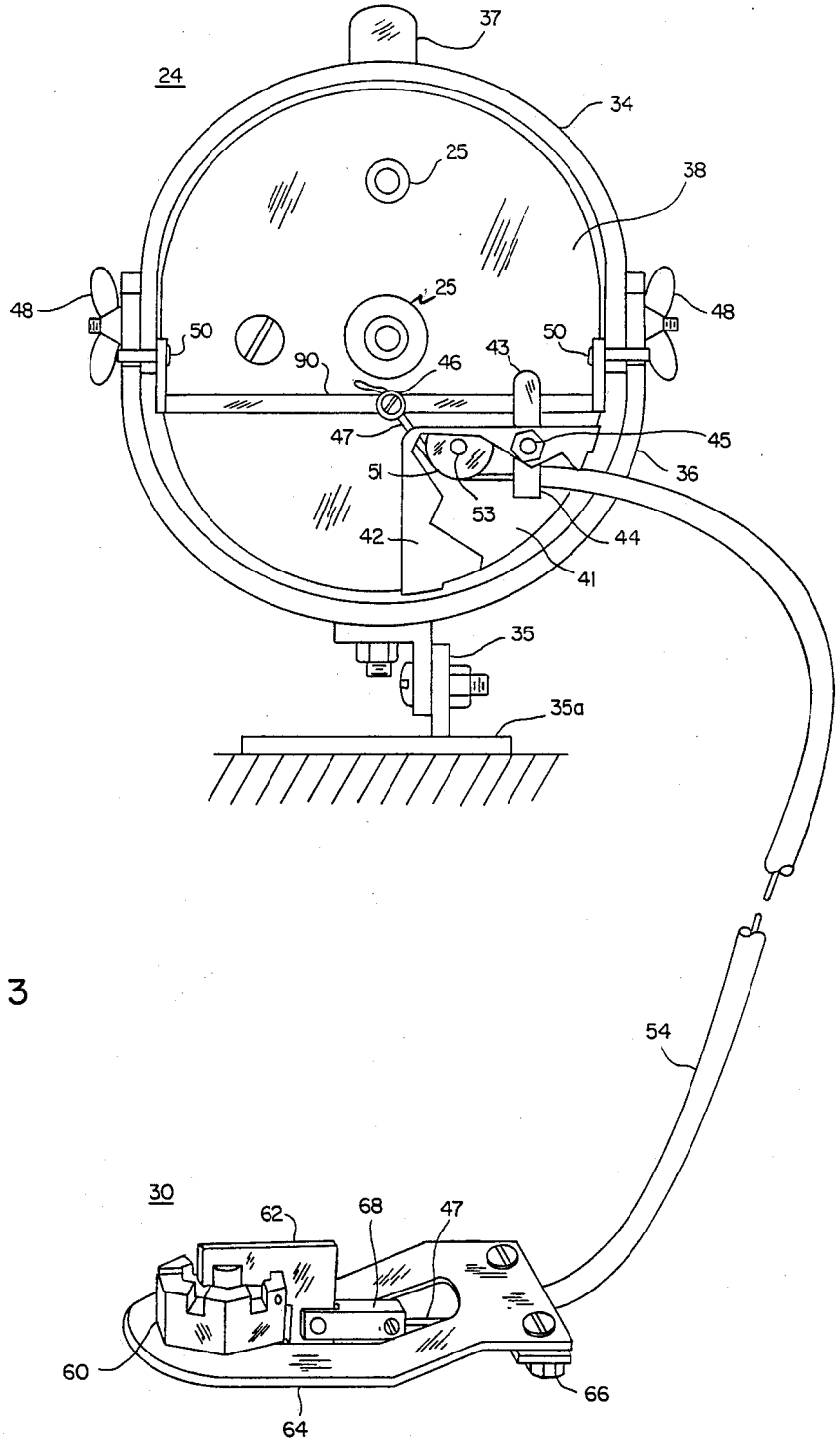
FIG. 3 is a top view of the remote oil filter and interlocked drain arrangement of the invention.

In FIG. 3, the oil filter mounting means 24 is shown. It includes an oil filter plate 38 of generally circular construction that is supported between a pair of C-shaped brackets 34 and 36 by means of a pair of screws 48 with winged heads. Outer C-shaped bracket 36 may be provided with any suitable means, such as mounting bracket 35, for supporting the oil filter on an adjacent surface or firewall of the engine compartment.

A pair of mounting plates consisting of a lower mounting plate 41 and an upper mounting plate 42 that is spaced above mounting plate 41, are affixed to the top surface of plate 38. Lower plate 41 is attached to oil filter plate 38 by means of depending legs and screws as illustrated at **38*a* (see FIG. 4). Upper plate 42 is partially cut away to illustrate a generally semi-circular guide 51 mounted between upper plate 41 and lower plate 42 by means of a pin 53 extending therethrough. The outer edge of guide 51 provides a guide surface for a cable 47 which runs in cable sheath 54. A U-shaped pull bracket 90 is affixed at either end by a pair of pins 50 to bracket 34 such that when bracket 34 is rotated, pull bracket 90 is moved horizontally with respect to the top surface of oil filter plate 38. A cable end clamp 46 is mounted on pull bracket 90 for moving cable 47 in cable sheath 54 to operate the drain valve means 30. A mounting stud or bolt 45 extends between plates 41 and 42 and secures both a cable clamp 44, for holding one end of cable sheath 54 rigid, and a guide 43, that extends over pull bracket 90 to restrict the movement of pull bracket 90 to a direction parallel to the surface of oil filter plate 38**.

As best seen in FIGS. 4 and 5, a pair of oil hose fittings 25 each have a threaded end that is securely affixed to plate 38 and an enlarged coupling end arranged to accept hoses 23 thereover. The hoses are maintained in position by means of suitable hose clamps 23*a*. Bracket 34 is pivotally movable about winged screws 48 and is thus movable relative to bracket 36 and oil filter plate 38. Bracket 36 includes cut-out portions 52, which in conjunction with a pair of pins 50 extending through the ends of bracket 34, establish limits for restricting the range of pivotal movement of bracket 34 with respect to bracket 36 and oil filter plate 38. A canister-type oil filter 28 is shown attached to oil filter plate 38 in FIG. 4. A depending stop 37 is affixed to bracket 34 and includes a tab 37*a* which extends close to oil filter 28. As shown in FIG. 5, when filter 28 is removed, bracket 34 may be pivoted in a downward direction with respect to bracket 36 since oil filter 28 no longer obstructs its path of travel. A screw thread fitting 40 in conjunction with a circular gasket 39 on the underside of the oil filter plate 38, serves to secure oil filter 28 in operating position.

Figure 6:
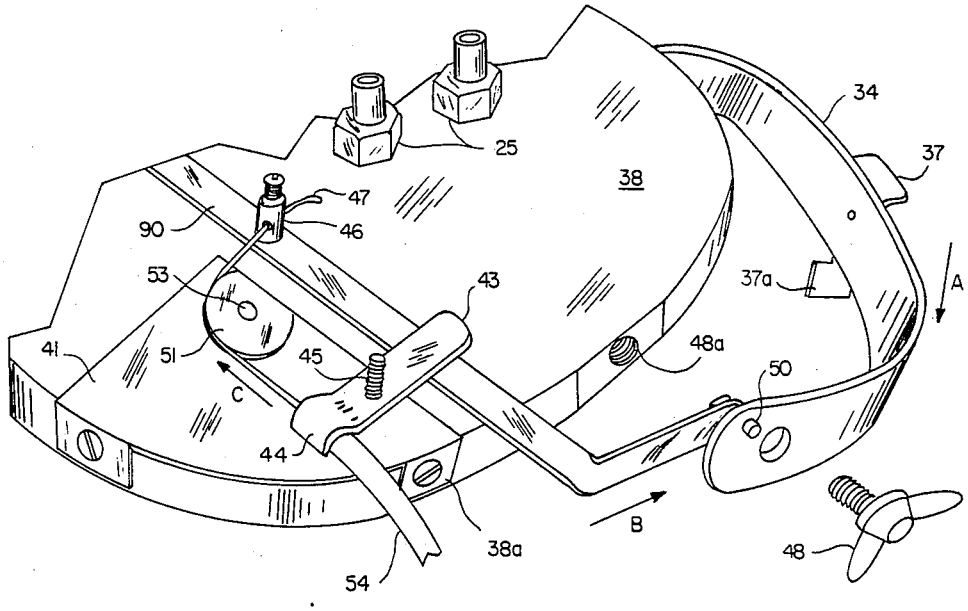
FIG. 6 is a partial exploded view of the apparatus of FIGS. 4 and 5.

FIG. 6 shows the operative portions of the interlock mechanism of the invention in more detail. Specifically, as bracket 34 is moved downwardly in a direction indicated by arrow A, pull bracket 90 is moved horizontally across the surface of oil filter plate 38 in the direction indicated by arrow B. This is so since pins 50 that attach bracket 34 and pull bracket 90 are offset from the axis defined by the center lines of winged screws 48, about which bracket 34 is rotatable. Winged screws 48 are threadingly engaged in threaded holes 48*a* on each side of oil filter plate 38. Movement of pull bracket 90 results in pulling cable 47 in a direction indicated by arrow C since cable clamp 46 is attached to pull bracket 90 and cable clamp 44 holds cable sheath 54 stationary with respect to oil filter plate 38.

Figure 7:
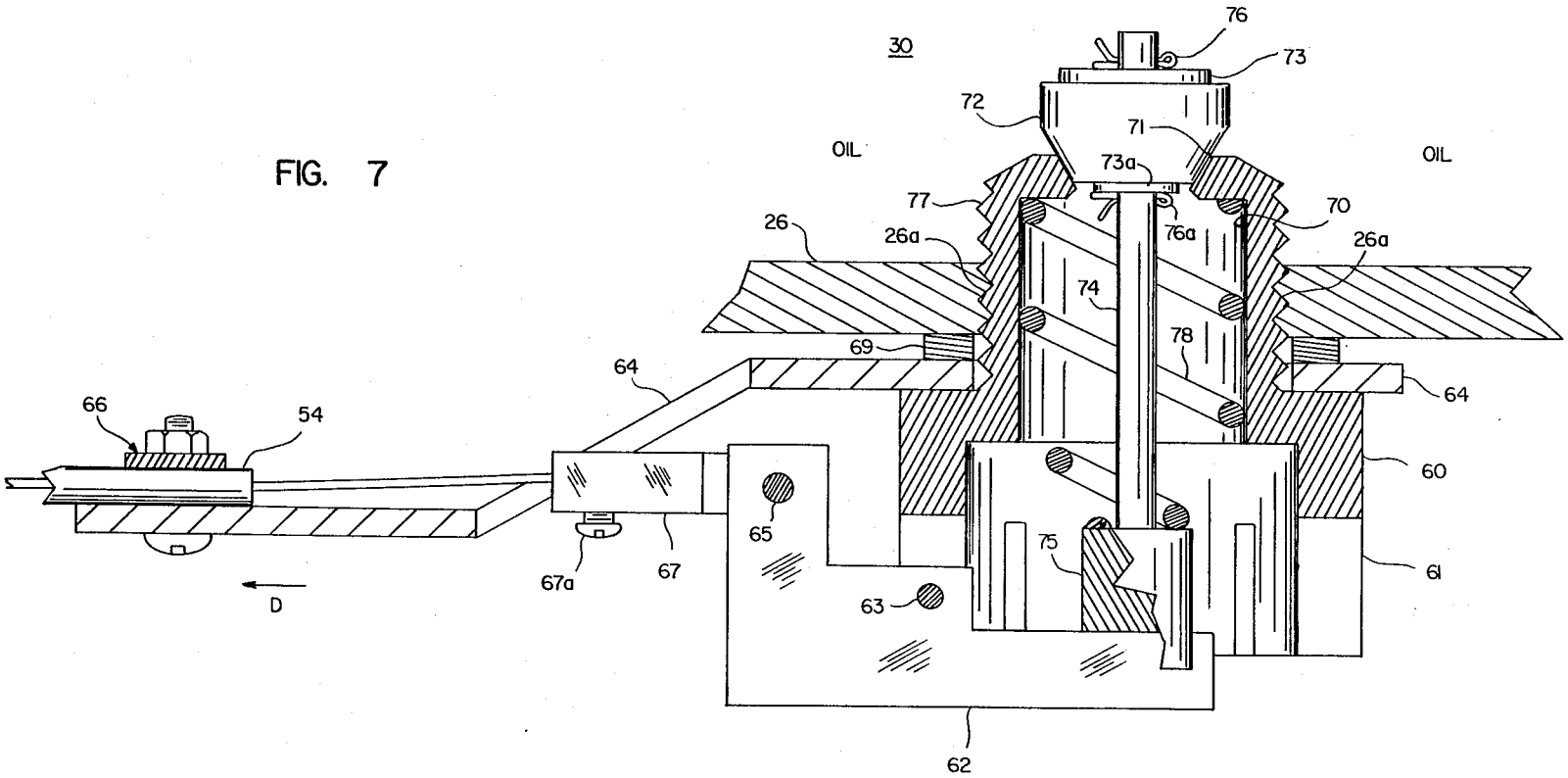
FIG. 7 is an enlarged, partial cross sectional view of the remote oil drain used with the invention.

Reference to FIG. 7 will illustrate operation of the remote drain means 30. As shown in the partial cross section of the sump 26, a threaded opening 26*a* is provided for reception of a threaded drain plug (not shown). The normal drain plug has been removed and replaced with a specially constructed drain fitting comprising a hollow castellated head 60 and a cylindrical threaded portion 77. The drain fitting is secured in threaded opening 26*a* and also secures a mounting plate 64 to sump 26. A sealing gasket 69 assures a tight fit between the various parts to prevent leakage of oil. Castellated head 60 has slotted portions 61, one pair of which is used to mount a pin 63 for pivotally securing an L-shaped lever 62. Lever 62 is connected at one end by a pin 65 to a clevis 67 which includes cable end clamp means 67*a* for securely affixing the remote end of cable 47 thereto. The other end of lever 62 extends through a slot in the cam end 75 of a valve shaft 74 which extends through the cylindrical opening 70 of drain means 30. Cam head 75 is shown partially cutaway to illustrate the arrangement. The underside of cam end 75 is biased downwardly by means of a coil spring 78 arranged within cylindrical opening 70. Coil spring 78 also provides a restoring force that acts against movement of pull lever 90. At the other end of shaft 74, a valve plug 72 is arranged for mating engagement with a valve seat 71 formed in the bottom of threaded portion 77. Suitable washer and pin arrangements 73 and 76 and 73*a* and 76*a* maintain valve plug 72 in position on shaft 74. As may be readily noted, cable sheath 54 is secured to plate 64 by means of a clamp arrangement 66. Upon movement of the cable 47 in a direction indicated by arrow D, in response to movement of pull bracket 90 in FIG. 6 in the direction B, lever 62 pivots about pin 63 to raise shaft 74 and result in valve plug 72 moving away from valve seat 71 to enable the oil in the sump to drain out through cylindrical opening 70.

Figure 10:
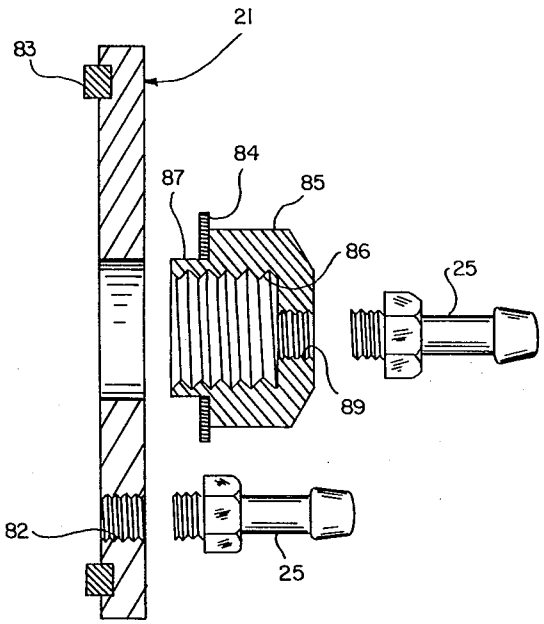
FIGS. 8, 9 and 10 illustrate, respectively: the engine oil filter mount; and the engine adapter plate and associated fittings used with the invention.
Figure 9:
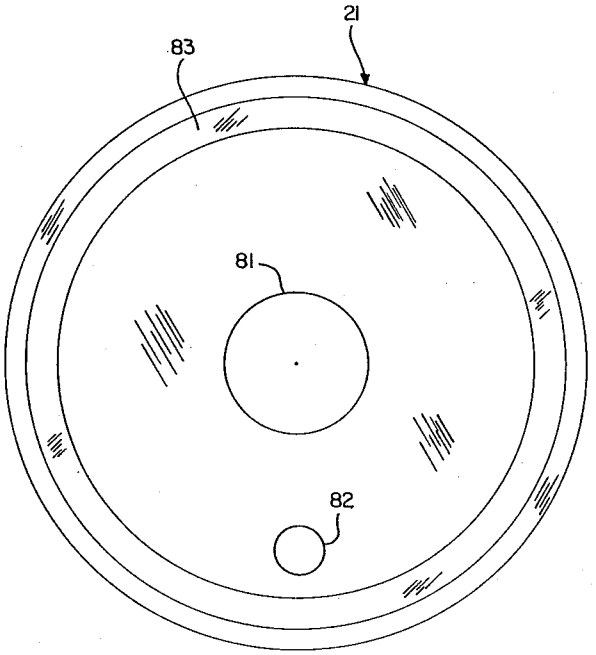
Figure 8:
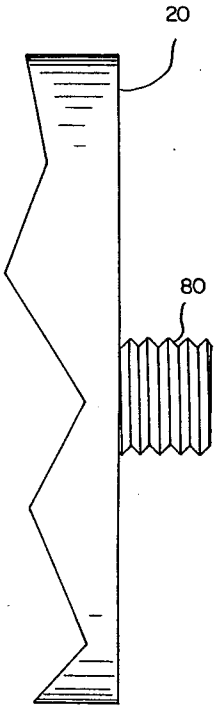

Referring to FIGS. 8–10, engine adapter plate 21 includes a large central aperture 81 which is designed to fit over a threaded filter mounting pipe 80 by means of which an oil filter is conventionally attached to the engine. A circular gasket 83 of square cross section is positioned in a suitably formed annular channel in engine adapter plate 21 for sealing against the surface of engine mount 20. A threaded return oil hole 82 is also provided in engine adapter plate 21 for reception of a threaded hose fitting 25. A large hollow shoulder nut 85 has an internally threaded surface 86 adapted for mating engagement with externally threaded filter mounting pipe 80. A smaller diameter shoulder 87 is designed to fit within hole 81, and a suitable gasket 84 is provided for making a seal between engine adapter plate 21 and hollow shoulder nut 85. A smaller threaded opening 89 is provided in the top of hollow shoulder nut 85 for receiving a hose fitting 25 therein.

In use, the original oil filter supplied with the vehicle engine is removed, and an engine adapter plate 21 is affixed to the filter mounting pipe 80 by means of hollow shoulder nut 85 and sealing washer 84. High pressure oil hoses are installed on hose fittings 25 by means of suitable hose clamps, such as clamps 23*a*, their other ends being similarly installed on hose fittings 25 on the oil filter plate 38. The oil filter plate 38 is positioned in a convenient location within the engine compartment by means of C-shaped brackets 34 and 36 and mounting brackets 35 and 35*a* and affixed to a wall surface in the engine compartment by conventional fastening means (not shown). The factory drain plug in the engine sump is replaced by drain means 30. Any needed adjustments in the length of cable 47 may be made by loosening the screw in cable end clamp 46. With cable 47 properly set, valve plug 72 in drain means 30 is firmly seated against seat 71 when the pull bracket 90 is in its full forward position and bracket 34 is substantially parallel with bracket 36 and the surface of adapter plate 38. In this connection, it will be appreciated that the oil filter need not be installed with oil filter plate 38 being horizontal; the provision of mounting brackets 35 and 35*a* enable mounting of the oil filter plate at different angles. Movement of pull bracket 90 in response to downward movement of bracket 34 results in cable 47 pivoting lever 62 to open the valve and allow the oil to drain from the sump. Winged screws 48 may be tightened to secure the mechanism and loosened when it is desired to operate the drain valve.

As mentioned previously, the original oil filter supplied by the manufacturer may be used in the remote location. Alternatively, a different oil filter (or oil filters) may be used. It is significant to note that many automobile engines would benefit from the use of larger oil filters, and with the invention, that option is readily made available. It is also to be noted that multiple oil filters can also be used by a relatively simple modification of the structural elements of the invention. When the oil filter is installed, stop 37*a* prevents downward rotational movement of bracket 34 and thus precludes the operation of lever 62 in the drain means. This interlock feature, which prevents operation of the drain means while the filter is installed, is a key aspect of the invention. While the prior art includes means for preventing inadvertent operation of the remote drain, the present invention interlock is simple and substantially foolproof since the drain can only be opened when the filter has been removed—thus assuring a disabled engine.

What has been described is a novel, remotely positionable oil filter and remotely operable drain means for an automobile engine with a simple interlock arrangement that prevents operation of the drain means while the filter is in place. It is recognized that numerous modifications and changes in the described embodiment of the invention will be apparent to those skilled in the art without departing from its true spirit and scope. The invention is to be limited only as defined in the claims.

What is claimed is:

1. In combination with an internal combustion engine having a sump for holding oil and oil filter attachment means on the engine;

adapter means coupled to said attachment means for enabling installation and operation of an oil filter at a point remote from said engine;

drain means in said sump for draining said oil;

said drain means including cable means for enabling draining of said oil from a remote point without removal of said drain means; and interlock means precluding operation of said drain means when said oil filter is installed.

2. The combination of claim 1 wherein said adapter means includes an adapter plate mounted to said attachment means and an oil filter plate for mounting a standard canister-type oil filter thereto.

3. The combination of claim 2, further including a mounting bracket affixed to said oil filter plate for locating said oil filter at said remote point.

4. The combination of claim 3 wherein said interlock means comprises a rotatable bracket for operating said cable means, said rotatable bracket being positioned such that said oil filter, when installed, obstructs movement of said rotatable bracket to prevent operation of said cable means.

5. The combination of claim 4 wherein said adapter means further includes a pair of high pressure hoses and suitable connections between said adapter plate and said oil filter plate.

6. The combination of claim 5 wherein said drain means includes an axially movable valve and spring means for urging said valve to a closed position.

7. In combination with an internal combustion engine having a sump for holding oil and an oil filter attachment on the engine, said engine being situated in a compartment in a vehicle;

an adapter plate mounted to said oil filter attachment and including a pair of high pressure hoses;

an oil filter plate for supporting a canister-type oil filter, said oil filter plate being connected to said high pressure hoses whereby oil being circulated in said engine is passed through said high pressure hoses to said filter;

means for mounting said oil filter plate and filter within said engine compartment at a point remote from said engine;

drain means mounted in said sump and including a movable valve which when opened, permits oil in said sump to be drained therefrom;

a lever in said drain means for operating said valve;

a cable for operating said lever, said cable extending to said oil filter plate;

interlock means mounted to said oil filter plate for operating said cable means to open and close said valve; and a movable bracket mounted on said oil filter plate and coupled to said cable means, said movable bracket being impeded from movement by the presence of an oil filter on said oil filter plate whereby said drain means cannot be operated by said cable means when said oil filter is in place.

* * * * *